US005094717A

United States Patent [19]

Manning et al.

[11] Patent Number: 5,094,717

[45] Date of Patent: Mar. 10, 1992

[54] SYNTHETIC FIBER PAPER HAVING A PERMANENT CREPE

[75] Inventors: James H. Manning, Appleton, Wis.; Irwin M. Hutten, Atlanta, Ga.

[73] Assignee: James River Corporation of Virginia, Richmond, Va.

[21] Appl. No.: 613,308

[22] Filed: Nov. 15, 1990

[51] Int. Cl.[5] ..... D21H 13/10

[52] U.S. Cl. ..... 162/111; 162/146; 162/207

[58] Field of Search ..... 162/111, 112, 113, 146, 162/207

[56] References Cited

U.S. PATENT DOCUMENTS

| | | | |
|---|---|---|---|
| 3,846,228 | 11/1974 | Ely et al. | 162/111 |
| 4,204,054 | 5/1980 | Lesas et al. | 536/56 |
| 4,640,810 | 2/1987 | Laursen et al. | 264/518 |
| 4,645,566 | 2/1987 | Kato et al. | 162/138 |
| 4,655,877 | 4/1987 | Horimoto et al. | 162/146 |
| 4,790,907 | 12/1988 | Mallen et al. | 162/157.1 |

FOREIGN PATENT DOCUMENTS

| | | | |
|---|---|---|---|
| 767632 | 11/1971 | Belgium | 162/111 |
| 2615889 | 10/1977 | Fed. Rep. of Germany | 162/146 |
| 1534782 | 8/1968 | France | 162/111 |
| 48-1443 | 1/1973 | Japan | 162/111 |
| 48-2681 | 1/1973 | Japan | 162/146 |
| 572962 | 10/1945 | United Kingdom | 162/146 |

*Primary Examiner*—Peter Chin

[57] ABSTRACT

A wetlaid paper-like nonwoven structure having a permanent crepe which does not wash out. The paper-like structure contains a synthetic bicomponent fiber in an amount of less than 20% by weight and as such possesses both wet and dry strength and improved absorbent properties.

20 Claims, No Drawings

SYNTHETIC FIBER PAPER HAVING A PERMANENT CREPE

BACKGROUND OF THE INVENTION

1. Field of the Invention

The present invention is directed to a wetlaid paper-like nonwoven structure having a permanent crepe which does not wash out. More particularly, the present invention is directed to a paper-like structure with a permanent crepe, for example, a wipe structure which possesses both wet and dry strength and improved absorbent properties. The present invention is also concerned with the method of manufacturing such paper-like structures.

2. Description of the Background Art

Crepe tissue products have a general utility in applications where absorbency is a factor. These include, for example, household and industrial wipes, towels, packaging, cushioning materials and the like.

In recent years, paper products made from wood pulp combined with various types of synthetic polymers have been investigated with the intention of imparting to paper products made from wood pulp, those advantageous properties which can be introduced by the presence of synthetic polymeric materials. Thus, for example, Japanese Publication No. 48-1443 (1973) discloses creping a web from a heated roller wherein the web contains at least 20 percent by weight of a thermoplastic synthetic fiber. Thus, raw paper containing at least 20 percent by weight of thermoplastic synthetic fiber is conveyed around a pair of heating rollers having a surface temperature which varies from the softening point of the synthetic fiber to about 30° C. above its melting point. The raw paper, which is heated on the rollers, is continuously scraped off the surface of the roller by means of a fixed doctor knife, thereby forming crepe patterns on the paper. The paper is then conveyed around a cooling roller to heat-set the crepe pattern. This publication specifically indicates that if there is any deviation in the amount of thermoplastic synthetic fibers included in the raw paper, for example, if the percentage weight of the thermoplastic synthetic fiber in the raw paper is less than 20 percent, crepe paper of the type desired by the publication cannot be achieved.

U.S. Pat. No. 4,640,810 discloses in column 4, lines 41–47, the general advantages of providing a mixture of relatively long thermoplastic fibers and wood pulp fibers wherein the thermoplastic fibers are activated by the application of heat and/or pressure.

U.S. Pat. No. 4,204,054 discloses fibrous structures in sheet form having from 10 percent to 90 percent by weight of pulp of cellulosic fibers crosslinked with formaldehyde, and 90 percent to 10 percent by weight of an additional binding product, with the amount of the additional binding product being selected to insure sufficient strength and cohesion to the structure of the sheet. The additional binding product is a non-crosslinked fiber which, in one variation, can be a synthetic pulp, such as for example low density polyethylene fibers, present within the range of 10 to 40 percent and preferably about 15 percent.

U.S. Pat. No. 4,790,907 discloses in column 1, lines 53 to 62 that synthetic pulps, filaments and fibers are useful for the manufacture of paper articles and can be used with conventional papermaking equipment. Common synthetic materials used in the paper pulps include high density polyethylene or polypropylene, and aramids, for example, Kevlar and Nomex. Pulps prepared from other polymers are also known, for example, aliphatic polyamides, polyvinyl chloride, acrylonitrile homopolymers and copolymers with halogenated monomers, styrene copolymers and mixtures of polymers.

U.S. Pat. No. 4,645,566 discloses a process for producing an electroconductive film wherein a thermoplastic synthetic pulp is mixed with a thermoplastic composite fiber having as a first component a lower melting point than that of said thermoplastic synthetic pulp and a second component having a higher melting point than that of said thermoplastic synthetic pulp.

U.S. Pat. No. 4,655,877 discloses an absorbent web structure composed of short fibers of a thermoplastic resin which is rendered hydrophilic with a surface-active agent mixed with cellulosic fibers, said thermoplastic short fibers being melt-bonded to impart self-supporting properties to the web structure.

Finally, U.S. Pat. No. 3,846,228 discloses forming tissue paper by pressing the web while on an up-running forming wire and transferring the web directly to a Yankee Dryer where it is creped. There appears to be no indication that the paper utilized in this patent contains synthetic fibers.

SUMMARY OF THE INVENTION

Because of the many advantageous properties which can be introduced into a paper-like material by the addition of a thermoplastic synthetic fiber, there has been a continual interest in processing such paper-like materials to produce a paper-like material which possesses a permanent crepe which will not wash out.

According to the present invention it has been found that the presence of a small amount of thermoplastic fiber, when added to a wood pulp furnish is effective in producing a paper-like web which can be permanently creped on a dryer, advantageously a Yankee Dryer. The crepe is thermally blended into the substrate so that even when the substrate is soaking wet, the crepe will not wash out. In addition, when mildly stretched, because of its elastic nature, the substrate will return to its original dimensions when tension is released. Because of the elastic nature of the creped product, it is not necessary to subsequently treat the paper-like material with a latex in order to introduce such an elastic characteristic. However, the elastic properties of the permanent crepe can frequently be enhanced if the creped paper-like product is subsequently treated with a latex material.

DETAILED DESCRIPTION OF THE INVENTION

According to the present invention it has been found that if less than 20% by weight of a thermoplastic synthetic fiber is mixed with a wood pulp to form a furnish, a web can be produced which can be permanently creped on a heated roller, such as for example a Yankee Dryer to achieve a crepe in the tissue which will not wash out. By achieving a permanent crepe without the utilization of a latex treatment, increased absorbency properties and strength can be achieved without the crepe being washed out. If desired, enhanced elasticity can be achieved by the subsequent treatment of the creped paper-like product with a latex material.

According to the present invention, the wood pulp and synthetic fibers are mixed with water in a hydropulper to form a uniform dispersion. The uniform dispersion of the synthetic fibers in the wood pulp can be achieved by following one of several techniques. The preferred manner of dispersion is the "Associate of Thickener" method described in U.S. Pat. No. 4,925,528. The Brandon "Air Emulsion" technique is described in U.S. Pat. No. 4,049,491. The James Cheshire foam method of dispersion shown in U.S. Pat. No. 4,498,956 can also be effectively utilized.

The dispersion of the synthetic fibers in the wood pulp possesses a solids concentration of about 1 to 2% by weight. The dispersion is then transferred to a forming unit (head box) where water is added to a solids concentration of about 0.1 to 0.5% by weight solids. From the forming unit the slurry is filtered on a screen and wet pressed between belts and rolls to a solids concentration of about 30 to 50%. The paper slurry is then introduced onto the surface of a dryer, for example a Yankee Dryer, where the water is further removed to a solids content of about 95 to 100%. The Yankee Dryer is internally heated with steam at a pressure of about 100 psi, and to further facilitate the heat treatment of the paper composite material, a hood can be provided to cover a portion of the circumferential surface of the drum. The hood advantageously prevents the escape of heat from the surface of the drum and can also be provided with gas heaters whereby hot air is blown against the paper composite material traversing the drum surface to assist in the drying operation. The hot air can be replaced or augmented with infra red heaters.

The paper composite material traverses about ½ of the drum surface in the form of a flat sheet and is caused to stick to the drum surface by the application of an adhesive to the drum surface, the addition of an adhesive to the paper composite or a combination of both.

In the final stage of the crepe formation at least one doctor blade is utilized to remove the paper from the surface of the drum as a crepe paper-like product.

The temperature of the Yankee Dryer is regulated to that temperature at which the particular synthetic thermoplastic material begins to melt. With the use of a hood, the temperature of the dryer can be controlled up to about 330° F.

The thermoplastic synthetic fibers which can be utilized in the present invention include those fibers which will melt or soften at a temperature below about 300° F. Typical thermoplastic synthetic fibers include polyolefins containing 1 to 8 carbon atoms, e.g. polyethylene, polypropylene, polybutylene, and copolymers thereof, polytetrafluoroethylene, polyesters, e.g. polyethylene terephthalate, polyvinyl acetate, polyvinyl chloride acetate, polyvinyl butyral, acrylic resins, e.g., polyacrylate, and polymethylacrylate, polymethyl methacrylate, polyamides, namely nylon, polyvinyl chloride, polyvinylidene chloride, polystyrene, polyvinyl alcohol, polyurethanes, cellulosic resins, namely cellulosic nitrate, cellulose acetate, cellulose acetate butyrate, ethyl cellulose, etc., copolymers of any of the above materials, e.g., ethylene-vinyl acetate copolymers, ethylene-acrylic acid copolymers, styrene-butadiene block copolymers, Kraton, and the like.

Also, the thermoplastic synthetic fibers can be a composite structure having a sheath-core configuration. Thus, the thermoplastic fibers include a thermoplastic material as a core fiber surrounded by another thermoplastic material which functions as a sheath surrounding the core fiber. Thus, for example, the sheath fiber can be a low-melting polypropylene which surrounds a higher melting polyester core. Thus, in such a sheath-core construction, the sheath-component always has a lower melting point when compared to the higher-melting point core component. The core fiber can also be made of a thermosetting resin such as phenol-formaldehyde, phenol fufural, urea-formaldehyde, melamine-formaldehyde, silicone rubber and the like.

According to the present invention, wood pulp fibers are dispersed with less than 20% by weight of the thermoplastic synthetic fiber or mixture of fibers. Advantageously, the thermoplastic synthetic fibers are present in an amount of about 5 to less than 20% by weight, preferably about 12 to 18% by weight. A particularly preferred blend is a paper composite comprising about 85% by weight wood pulp fiber and about 15% by weight of synthetic fiber.

By using less than 20% by weight of the synthetic fiber, longer and finer fibers can be utilized which are effective in producing a network which provides a stronger final product which possesses a permanent elastic crepe. The size of the synthetic fiber is the finest which can be obtained, such as for example from about 1.2 d to 4 d. The length of the fibers can vary from about ½" to 1 ¼", advantageously about ¾" to 1". The denier and length of the thermoplastic synthetic fibers can be varied, depending on the combination of the denier and length of the fiber. Thus, a lower denier fiber would advantageously be used with a larger length fiber.

The wood pulp which can be used in the present invention is any typical wood pulp which can be used to make paper including the typical fiber size associated such wood pulp.

After the paper is creped from the Yankee Dryer, it is collected on a take-up ream. The paper can be creped, for example, to 5% to 40% off the Yankee Dryer, which means that the ream must run 5 to 40% slower to collect the creped paper on the ream. Typically paper is creped to about 15% off a Yankee Dryer.

The creped paper-like product of the present invention is a very unique structure possessing a permanent, elastic crepe. The crepe is thermally-molded into the substrate so that even when the substrate is soaking wet, the crepe does not wash out.

In addition, when mildly stretched, the substrate returns to its original dimensions when tension is released. Thus, the permanent thermally-molded crepe is accomplished by creping the substrate off the Yankee Dryer after the wet-laid structure had been dried and while it is still hot.

Another advantage is that the thermally-bonded substrate has sufficient dry and wet strength to be used as a wipe. Most premium wipes in the market place are latex treated. While the latex is very effective in boosting the strength of the wipe providing it with scrub resistance, the latex also interferes with the absorbency of the wipe. Since the thermally-bonded web of the present invention does not contain a latex it has superior wipe and absorbency properties. In addition, the permanent crepe built into the substrate increases the surface area for absorption. There is also an indication that the thermal-bonding fiber in the web structure is oleophobic. This would explain why the web possesses excellent characteristics for absorbing oil and other organic liquids.

Another advantage of the paper-like material of the present invention is in its medical application. Thus, the paper product can be used as a garment for doctors, nurses or patients and also as a medical instrument wrap whereby the medical instruments can be sterilized while the paper wrap is disposed around the instruments. The paper product can also be used as a lidding, i.e., a sheet disposed over medical trays or placed in disposable medical kits as a lid therefor. Since the lidding is steam permeable and water impermeable, it can be present when the entire unit is sterilized. Since many medical kits are disposable, they can be readily thrown away after use. In a further use, the crepe paper product can be used as a sterile peel pouch for housing surgical gloves.

The creped paper produced by the process of the present invention can be subsequently treated with latex if it is desired to add further strength to the paper product while reducing linting. Also the paper product can be treated with a fluorocarbon to provide water and oil repellency (Scotch Guard). The latex and fluorocarbon treatment can be separate or combined treatments and can be applied by spraying, foaming and/or dip saturation.

DESCRIPTION OF THE PREFERRED EMBODIMENTS

Example 1

A trial run is made with a furnish of 10% DuPont 271P PET/PET bicomponent 4 d×¾" fiber, which is a low melting copolyester sheath which surrounds a higher melting polyethylene terephthalate core, and 90% Marathon northern softwood bleached kraft pulp. The batch fiber-water dispersion is made up in a mix tank equipped with an agitator in the following order:

(a) 980 gallons of water heated to 90° F.;
(b) 37 pounds of pulp;
(c) 378 g of the Rohm and Haas associative thickner Acrysol QR-708, which is a linear block copolymer of polyethylene oxide and an aliphatic polyurethane as disclosed in U.S. Pat. No. 4,925,528;
(c) 4 pounds of the bicomponent fiber; and
(d) 378 g of Calgon Hydraid 7300C predissolved in 17 gallons of water. Calgon Hydraid is a viscosity modifier, that is, an anionic polymer, e.g., a sulfonated polyacrylamide such as shown in U.S. Pat. No. 4,925,528.

The mixture is agitated for 15 minutes and then pumped with a centrifugal pump to the exit side of a fan pump where it is diluted to produce a consistency of 0.05% with white water that contains 50 ppm Acrysol QR-708 and 50 ppm Hydraid 7300C. A dispersion is formed on an inclined wire fomrer to a basis weight of 20 lb/3000 sq.ft. The web is then dried and thermally bonded on a Yankee Dryer heated to 265° F. and subsequently creped.

Example 2

A trial run is made with a furnish of 15% Hoechst Celanese 255, 3 d×½" bicomponent fiber (celbond), which is a polyethylene sheath surrounding a polyethylene terephthalate core, and 85% Marathon northern softwood bleached kraft pulp. The batch fiber-water dispersion is made up in a mix tank equipped with an agitator in the following order:

(a) 980 gallons of water heated to 90° F.;
(b) 35 pounds of pulp;
(c) 378 g of Rohm and Haas Acrysol QR-708;
(d) 6 pounds of the bicomponent fiber;
(e) 378 g of Calgon Hydraid 7300C predissolved in 17 gallons of water.

The mixture is agitated for 15 minutes and then pumped with a centrifugal pump to the exit side of a fan pump where it is diluted to produce a consistency of 0.05% with white water that contains 50 ppm Acrysol QR-708 and 50 ppm Hydraid 7300C. The dispersion is formed on an inclined wire former to a basis weight of 15 lb/3000 sq.ft. The web is then dried and thermally bonded on a Yankee Dryer heated to 265° F. and subsequently creped.

FIG. 1 of U.S. Pat. No. 4,049,491 shows a typical inclined wire machine for making wet laid nonwovens. However the secondary dilution step is not necessary in the dispersion system utilized in the present invention. Also, the Moyno pumps can be replaced with conventional and less expensive centrifugal pumps.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A paper with a permanent, thermally-bonded crepe which comprises wood pulp, and less than 20% by weight of a synthetic fiber, said synthetic fiber having a sheath-core bicomponent fiber construction wherein the sheath has a lower melting point than the higher melting point core said synthetic fiber having a denier of 1.2 d to 4 d and a length of about ½ inch to 1 ¼ inches.

2. The paper of claim 1 wherein the synthetic fiber is present in an amount of about 5 to less than 20% by weight with the substantial balance being wood pulp.

3. The paper of claim 1 comprising 85% by weight wood pulp and 15% by weight of the synthetic fiber.

4. The paper of claim 1 wherein the sheath has a melting point of less than 300° F.

5. The paper of claim 1 wherein the paper is elastic.

6. The paper of claim 1 further provided with a latex material.

7. The paper of claim 1 wherein the sheath softens at a temperature below about 300° F.

8. The paper of claim 1 wherein the bicomponent fiber is selected from the group consisting of polyethylene, polypropylene, polybutylene, polyethylene terephthalate, polyvinyl acetate, polyacrylate, polymethylacrylate, nylon, polyvinyl chloride polystyrene, polyvinyl alcohol, polyurethanes, cellulosic and acrylic resins.

9. The paper-like structure of claim 1 wherein the paper-like structure is a wipe having both wet and dry strength and absorbency properties.

10. The paper of claim 1, wherein the core is a thermosetting resin selected from the group consisting of phenol-formaldehyde, phenol furfural, urea-formaldehyde, melamine-formaldehyde and silicone rubber.

11. A method for producing a paper with a permanent, thermally-bonded crepe which comprises mixing wood pulp and less than 20% by weight of a thermoplastic synthetic fiber with water to form a uniform dispersion, said synthetic fiber having a sheath-core bicomponent fiber construction wherein the sheath has a lower melting point than the higher melting point core, said synthetic fiber having a denier of 1.2 d to 4 d and a length of about ½ inch to 1 ¼ inches, transferring the dispersion to a forming unit where additional water is added to reduce the solids content, increasing the solids content by filtering the dispersion followed by wet pressing, drying the dispersion on a dryer to a solids content of about 95 to 100%, heating to melt or soften said bicomponent fiber and creping the paper-like product from the surface of the dryer to form a thermally bonded creped paper.

12. The method of claim 11 wherein the wood pulp is mixed with about 5 by weight of the thermoplastic synthetic fiber.

13. The method of claim 11 wherein the bicomponent fiber is selected from the group consisting of polyethylene, polypropylene, polybutylene, polyethylene terephthalate, polyvinyl acetate, polyacrylate, polymethylacrylate, nylon, polyvinyl chloride, polystyrene, polyvinyl alcohol, polyurethanes, cellulosic and acrylic resins.

14. The method of claim 11 wherein the addition of water forms a uniform dispersion with a solids content of about 1 to 2% by weight.

15. The method of claim 11 wherein the additional water lowers the solids content to about 0.1 to 0.5% by weight.

16. The method of claim 11 wherein filtering and pressing to remove the water increases the solids content to about 30 to 50% by weight.

17. The method of claim 11 wherein the drying to a solids content of about 95 to 100% by weight is conducted on a Yankee Dryer.

18. The paper-like structure of claim 1 wherein the bicomponent fiber has a length of about ¾ to 1 inch.

19. The method of claim 11 wherein the bicomponent fiber has a length of about ¾ to 1 inch.

20. The method of claim 11, wherein the core is a thermosetting resin selected from the group consisting of phenol-formaldehyde, phenol furfural, urea-formaldehyde, melamine-formaldehyde and silicone rubber.

* * * * *